US005275078A

United States Patent [19]

Wolf

[11] Patent Number: 5,275,078

[45] Date of Patent: Jan. 4, 1994

[54] SHOULDER REST FOR STRINGED MUSICAL INSTRUMENTS

[76] Inventor: Wilhelm Wolf, Hof Ter Weydeweg 1, NL - 3451 St Vleuten, Netherlands

[21] Appl. No.: 823,676

[22] Filed: Jan. 21, 1992

[30] Foreign Application Priority Data

Apr. 10, 1991 [DE] Fed. Rep. of Germany ..... 4111590

[51] Int. Cl.[5] ..... G10D 1/02

[52] U.S. Cl. ..... 84/280

[58] Field of Search ..... 84/278, 279, 280; 411/393, 591

[56] References Cited

U.S. PATENT DOCUMENTS

| | | | |
|---|---|---|---|
| 1,332,621 | 3/1920 | Ganiere | 84/280 |
| 2,272,852 | 2/1942 | Schaefer | 411/393 |
| 2,747,452 | 12/1952 | Goldberger | 84/280 |
| 3,479,916 | 1/1967 | Wolf | 84/280 |
| 3,683,098 | 8/1972 | Chavez, Jr. | 84/280 |
| 4,386,548 | 6/1983 | Wolf | 84/280 |

FOREIGN PATENT DOCUMENTS

| | | | |
|---|---|---|---|
| 2659869 | 3/1978 | Fed. Rep. of Germany | . |
| 2604897 | 6/1978 | Fed. Rep. of Germany | . |
| 3033310 | 6/1982 | Fed. Rep. of Germany | . |
| 8600940[U] | 4/1986 | Fed. Rep. of Germany | . |
| 2052828A | 1/1981 | United Kingdom | G10G 5/00 |

*Primary Examiner*—Michael L. Gellner
*Assistant Examiner*—Cassandra C. Spyron
*Attorney, Agent, or Firm*—Darby & Darby

[57] ABSTRACT

A shoulder rest for a stringed musical instrument has a carrier for a shoulder-engaging cushion and for two clamping devices which can engage opposite sides of the body of an instrument. One of the clamping devices is adjustably coupled to the carrier for movement toward and away from the other clamping device. The coupling comprises an elongated arm which is provided on the one clamping device and extends longitudinally of the carrier, two annular stops on the carrier, an elastically deformable sleeve-like self-locking bearing between the stops, and an affixing element adjacent the bearing and also located between the stops. The arm extends through the stops, through the bearing and through the affixing element, and the arm can be shifted longitudinally of the carrier by overcoming the resistance of the bearing. Once the arm assumes a desired position, a screw of the affixing element is caused to engage the arm and to fixedly retain it in the selected position. One of the stops is nearer to the one clamping device than the other stop, and the affixing element can be located between the one stop and the bearing. Alternatively, the bearing can be located between the one stop and the affixing element.

10 Claims, 1 Drawing Sheet

SHOULDER REST FOR STRINGED MUSICAL INSTRUMENTS

BACKGROUND OF THE INVENTION

The invention relates to improvements in shoulder rests for violins and analogous stringed musical instruments. More particularly, the invention relates to improvements in shoulder rests of the type disclosed in commonly owned German Pat. No. 26 04 897 (published Aug. 19, 1976 and granted Jun. 22, 1978), in commonly owned German Auslegeschrift No. 26 59 869 (published Aug. 18, 1977), in commonly owned German Pat. No. 30 33 310 (published Apr. 8, 1982 and granted Jun. 16, 1982) and in corresponding commonly owned U.S. Pat. No. 4,386,548 (granted Jun. 7, 1983).

The above enumerated commonly owned prior publications disclose shoulder supports wherein a first clamping device is movable toward and away from a second clamping device against the resistance of a self-locking sleeve which maintains the two clamping devices at a selected distance from each other. Reference may be had, for example, to the drawing of German Pat. No. 26 04 897 which shows a self-locking sleeve. The clamping devices can engage selected portions of the body of a stringed musical instrument and are mounted on a carrier which further supports a shoulder-engaging member, e.g., a pad or a cushion. The clamping devices are adjustable to change the distance of the respective portions of the carrier from the body of the musical instrument Such multiple adjustability enables the player to select an optimal position of the pad or cushion relative to the body of the musical instrument. Moreover, the shoulder rest can be affixed to instrument bodies having different sizes and/or shapes. Still further, the shoulder rest can be adjusted to fit the stature of the player, particularly the vertical distance of the clavicle from the chin.

A drawback of presently known shoulder rests is that the mutual spacing of the clamping devices cannot be fixed with a desired degree of reliability. Thus, if the stress upon the adjustable clamping device reaches a certain value, the self-locking sleeve yields and permits a shifting of the movable clamping device toward or away from the other clamping device This can affect the comfort and the quality of play of the person using the musical instrument. Aging of the self-locking sleeve is one of the primary reasons that the useful life of such sleeves is rather limited and that their self-locking action deteriorates with time.

Certain additional conventional shoulder rests are disclosed in U.S. Pat. No. 2,747,452 (granted May 29, 1956) to Goldberger and in commonly owned U.S. Pat. No. 3,479,916 (granted Nov. 25, 1969).

OBJECTS OF THE INVENTION

An object of the invention is to provide a shoulder rest which can be affixed to existing stringed musical instruments and is more reliable than heretofore known shoulder rests.

Another object of the invention is to provide a shoulder rest which is more versatile than conventional shoulder rests.

A further object of the invention is to provide a shoulder rest which can be affixed to or detached from the body of a stringed musical instrument without resorting to any tools.

An additional object of the invention is to provide a shoulder rest which can be used with equal advantage in conjunction with musical instruments having relatively large or slender bodies and which enables the user to carry out a practically infinite number of adjustments in the orientation of the shoulder engaging member relative to and in the distance of such member from the body of the musical instrument.

Still another object of the invention is to provide a novel and improved coupling between certain constituents of the above outlined shoulder rest.

A further object of the invention is to provide a shoulder rest whose ability to properly adhere to the body of a stringed musical instrument does not deteriorate with age and/or with the extent of use.

Another object of the invention is to provide a shoulder rest which exhibits all advantages of heretofore known shoulder rests but does not embody the drawbacks of such conventional shoulder rests.

An additional object of the invention is to provide a relatively simple and inexpensive shoulder rest which can be properly assembled independently of the body of a musical instrument to be thereupon rapidly and reliably connected to such body in order to maintain the shoulder engaging member in an optimum orientation relative to and at an optimum distance from the body.

A further object of the invention is to provide a novel and improved combination of a stringed musical instrument, such as a violin, and a shoulder rest of the above outlined character.

Another object of the invention is to provide a shoulder rest whose utility and versatility are not affected by the fact that it can reliably maintain the clamping devices at a selected distance from each other.

SUMMARY OF THE INVENTION

The invention is embodied in a shoulder rest which can be connected to the body of a violin or an analogous hand-held stringed musical instrument. The improved shoulder rest comprises a shoulder-engaging member, an elongated carrier for the member, a first clamping device connected to one of two spaced-apart portions of the carrier and engageable with a first part of the body of an instrument a second clamping device which is engageable with a second part of the body of an instrument, and means for adjustably coupling the second clamping device to the other portion of the carrier. The improved coupling means comprises an elongated arm which is provided on the second clamping device and extends substantially longitudinally of the carrier, two spaced apart annular stops which are provided on the carrier, a substantially sleeve-like bearing between the two stops, and an affixing element between the bearing and one of the stops. The arm extends longitudinally movably through the stops, through the bearing and through the affixing element, and the latter comprises means for releasably engaging the arm to thus maintain the second clamping device in a selected position relative to the carrier.

One of the stops is nearer to and the other stop is more distant from the second clamping device. In accordance with one presently preferred embodiment of the invention, the affixing element is disposed between the bearing and the one stop. Alternatively, the bearing can be disposed between the one stop and the affixing element.

The engaging means of the affixing element can comprise a threaded fastener. If such fastener is a bolt or a screw, its head can be provided with a polygonal socket for reception of a torque transmitting tool.

The bearing can be made, at least in part, of an elastomeric material, and the shoulder engaging member is or can be deformable.

At least one of the two clamping devices can comprise a first section which serves to releasably engage the body of an instrument, and a second section which is adjustably secured to the first section and is disposed at the respective portion of the carrier. The latter can include a plate.

The stops are preferably spaced apart a predetermined distance, and the combined axial length of the bearing and affixing element can at least approximate such predetermined distance.

At least one of the two stops can receive the arm with at least some radial play.

The novel features which are considered as characteristic of the invention are set forth in particular in the appended claims. The improved shoulder rest itself, however, both as to its construction and the mode of applying and adjusting the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
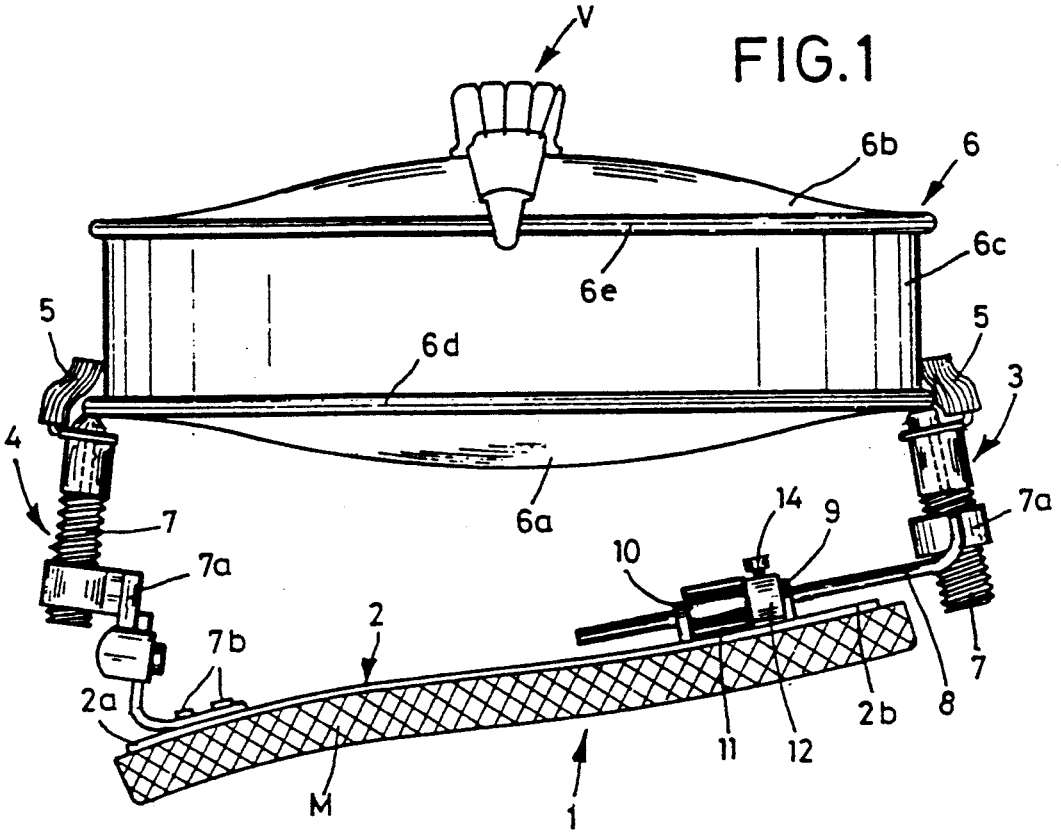
FIG. 1 is a front elevational view of a shoulder rest which embodies one form of the invention and is affixed to the body of a stringed musical instrument.

Referring first to FIG. 1, there is shown a shoulder rest 1 which can be separably connected to the body 6 of a violin V or an analogous hand-held stringed musical instrument. The body 6 has a suitably shaped rear wall 6*a*, a front wall 6*b*, a circumferentially extending intermediate wall or sidewall 6*c*, a rim 6*d* between the walls 6*a*, 6*c* and a rim 6*e* between the walls 6*b*, 6*c*. The improved shoulder rest 1 comprises an elongated plate-like carrier 2 which can be made of a resilient metallic or plastic material and is located behind and is spaced apart from the exposed side of the rear wall 6*a* of the body 6. That side of the carrier 2 which faces away from the rear wall 6*a* supports a preferably deformable (e.g., e y deformable) shoulder-engaging member M in the form of a cushion or pad. The latter can be made of foam rubber or any other suitable material which can reliably engage a portion of the garment covering the shoulder next to the instrument-holding hand of the player. The carrier 2 has two spaced-apart portions 2*a*, 2*b* (each of these portions can constitute an end portion of the carrier) The portion 2*a* is rigidly connected to an adjustable clamping device 4 having one or more claws 5 which clampingly engage the rim 6*d* at one side of the housing 6, and the portion 2*b* is adjustably coupled to a second adjustable clamping device 3 having one or more claws 5 which engage the rim 6*d* at the other side of the body 6.

Each of the two clamping devices 3, 4 comprises an externally threaded first section 7 which carries the respective claw or claws 5, and an internally threaded second section 7*a*. The section 7*a* of the clamping device 4 which is shown in FIG. 1 is secured to the respective portion 2*a* of the carrier 2 by one or more rivets, screws or other suitable fasteners 7*b*. The internally threaded section 7*a* of the clamping device 3 is provided with or connected to an elongated arm 8 which extends in the longitudinal direction of the carrier 2 and forms part of novel and improved means for adjustably coupling the clamping device 3 to the respective portion 2*b* of the carrier 2. Such coupling means further comprises two spaced-apart annular stops 9, 10 which are provided at the front side of the carrier 2 (namely, at the side which faces away from the shoulder-engaging member M and confronts the bottom wall 6*a* of the body 6), a substantially sleeve-like self-locking bearing 11 in the space between the stops 9, 10, and an affixing element 12 which is disposed between the bearing 11 and the stop 9, i.e., that stop which is nearer to the clamping device 3. The arm 8 extends through and is axially or longitudinally movable within the stops 9, 10, bearing 11 and affixing element 12.

The bearing 11 is made, at least in part, of an elastomeric material (such as rubber or an elastically deformable plastic substance) which offers a certain resistance to longitudinal movement of the arm 8 through its axially or longitudinally extending passage. The diameter of the passage in the bearing 11 can be selected in such a way that the surface surrounding the passage is in certain engagement with the adjacent portion of the external surface of the arm 8. The affixing device 12 can include a hoop which is made of a metallic or plastic material and carries a screw 14 serving as a means for releasably engaging the adjacent portion of the arm 8 in order to fix the clamping device 3 in a selected position relative to the carrier 2 and clamping device 4. The externally threaded shank of the screw 14 can be provided with a pointed tip which can be caused to strongly engage (and even penetrate into) the adjacent portion of the external surface of the arm 8.

The purpose of the sections 7, 7*a* of each of the clamping devices 3, 4 is to permit an adjustment of the distance of the respective portion 2*a*, 2*b* of the carrier 2 from the rear wall 6*a* of the body 6, i.e., to properly select an appropriate orientation of the shoulder-engaging member M relative to and an optimum distance of this member from the rear wall 6*a* when the instrument V is ready for use. FIG. 1 shows that the distance of the carrier portion 2*a* from the adjacent portion of the rim 6*d* can exceed (even considerably exceed) the distance of the carrier portion 2*b* from the nearest portion of the rim 6*d*.

The coupling means including the parts 8–12 and 14 serves to permit a selection of the distance between the claw or claws 5 of the clamping device 4 and the claw or claws 5 of the clamping device 3. This enables these clamping devices to reliably engage the adjacent portions of the rim 6*d* at the respective sides of the body 6. In order to engage the rim 6*d* with the claws 5 of the clamping devices 3 and 4, these clamping devices are moved to the positions which are shown in FIG. 1, and the distance of these clamping devices from each other thereupon remains unchanged because the preferably elastomeric bearing 11 engages the arm 8 with a force which suffices to prevent any accidental shifting of the arm 8 longitudinally of the carrier 2. Such retaining or self-locking action of the bearing 11 can be relied upon while the screw 14 is disengaged from the arm 8, i.e., it is possible to forcibly move the arm 8 relative to the stops 9, 10, bearing 11 and affixing element 12 in the longitudinal direction of the carrier 2. Once the operator has ascertained that the claws 5 of the clamping devices 3, 4 reliably engage the adjacent portions of the rim 6*d*, the screw 14 is tightened to engage the arm 8 and to thus relieve the bearing 11, i.e., the bearing no longer constitutes the only part of the coupling means which maintains the clamping devices 3, 4 at a desired distance from each other. The exposed end face of the head of the screw 14 is preferably provided with a non-circular socket (e.g., with a hexagonal socket, not shown) so that it can receive the working end of a suitable torque transmitting tool which is put to use in order to engage the shank of the screw 14 with or to disengage the shank from the adjacent portion of the arm 8 within the confines of the hooped or ring-shaped portion of the affixing device 12. The latter is adjacent and can form part of the right-hand stop 9.

The combined axial length of the bearing 11 and affixing element 12 preferably equals or approximates the distance of the stops 9, 10 from each other.

Figure 2:
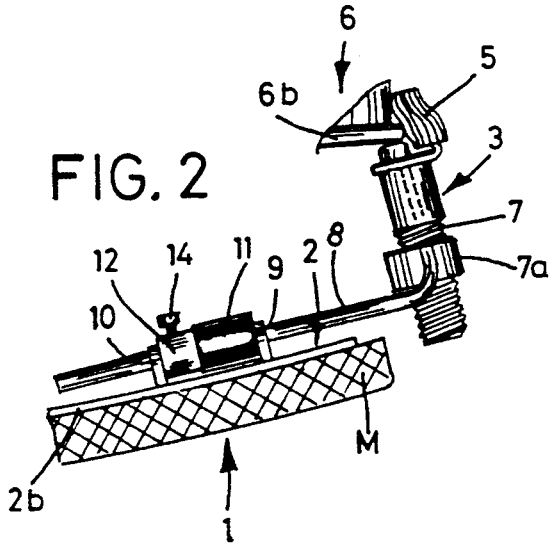
FIG. 2 is a fragmentary front elevational view of a portion of a modified shoulder rest and an end elevational view of a portion of the body of a musical instrument.

FIG. 2 shows a portion of the body 6 and a portion of a modified shoulder support 1, namely, a shoulder support which employs modified adjustable coupling means between the clamping device 3 and the carrier 2 for the member M. The difference is that the affixing element 12 is disposed between the bearing 11 and that stop (10) which is more distant from the clamping device 3. The stop 9 can be provided with an opening which receives the arm 8 with a certain amount of radial play so that the elastically deformable bearing 11 can undergo some radial deformation when the shoulder of the player bears against the underside of the member M in actual use of the instrument.

It will be seen that the only notable difference between the coupling means of FIGS. 1 and 2 is that the positions of the bearing 11 and affixing element 12 are interchanged (as considered in the longitudinal direction of the arm 8). The arm 8 can be made of a piece of strong wire or of any other suitable reasonably strong rod stock. The embodiment of FIG. 2 not only permits a certain amount of radial movability of the arm 8 relative to the stop 9 but, in addition, the arm 8 has a certain freedom of axial movement (longitudinally of the carrier 2) even if the shank of the screw 14 strongly engages the arm 8. The reason is that the bearing 11 is elastically deformable, i.e., the axial length of this bearing can be reduced by pulling the carrier 2 in a direction to the left and/or by pulling the clamping device 3 in a direction to the right. This feature ensures an even more reliable retention of the two clamping devices in engagement with the rim 6*d* of the body 6 because, once the screw 14 is driven home while the bearing 11 is maintained in axially stressed condition, the bearing 11 tends to expand axially and thereby urges the claw or claws 5 of the clamping device 3 against the adjacent portion of the body 6, i.e., toward the (non-illustrated) other clamping device of the shoulder rest 1 which is shown in FIG. 2. Moreover, such rather limited axial movability of the arm 8 relative to the carrier 2, while the screw 14 strongly engages the arm 8, can suffice to ensure that the shoulder rest 1 of FIG. 2 can be attached to or detached from the body 6 without prior loosening of the screw 14, i.e., merely as a result of axial deformability of the bearing 11 between the affixing element 12 and the stop 9.

On the other hand, the adjustable coupling means of FIG. 1 is even more reliable because the affixing element 12 is immediately adjacent and can be rigid with the stop 9. Thus, once the screw 14 of FIG. 1 is tightened to engage the arm 8, the latter can no longer move axially (longitudinally of the carrier 2) as long as the screw 14 remains tightened. It is only possible (provided that the affixing device 12 is not rigid with the stop 9 of FIG. 1) to move the arm 8 to the left in order to stress the bearing 11 between the affixing device 12 and the stop 10. Thus, whereas the coupling means of FIG. 2 permits separation of the shoulder rest 1 from the body 6 without prior loosening of the screw 14, the somewhat less versatile coupling means of FIG. 1 exhibits the advantage that it even more reliably prevents accidental separation of the respective shoulder support 1 from the body 6.

The adjustability of the arm 8 relative to the stops 9, 10, bearing 11 and affixing device 12 (while the screw 14 is loose) suffices to ensure that the improved shoulder rest can be separably connected with bodies 6 of different sizes. Furthermore, the user can affix the shoulder rest 1 of FIG. 1 or 2 close to or at a greater distance from that end of the body 6 which faces the observer of FIG. 1.

An important advantage of the improved shoulder rest is that the reliability of its connection to the body of a stringed musical instrument remains unchanged for long periods of time. Another important advantage of the shoulder rest is that it can be disengaged from the body 6 of an instrument with little loss in time; all that is necessary is to loosen the screw 14 and the clamping devices 3, 4 can be moved apart to disengage their claws 5 from the rim 6*d* of the body 6. Furthermore, the shoulder rest can be rapidly affixed to the body 6 and thereupon locked in the selected optimum position. Initial fixing is effected by the elastically deformable bearing 11, and the locking is effected by the screw 14 of the affixing element 12. Still further, and if one (such as 3) of the clamping devices 3, 4 is more or less permanently connected to the respective portion (2*a*) of the carrier 2, the user of the instrument V knows that the member M is located at one and the same distance from the respective side of the body 6 irrespective of whether the body 6 is narrow or wide; all that can change is the distance of the clamping device 3 from the clamping device 4 but not the position of the member M relative to the clamping device 4.

Another important advantage of the improved shoulder rest is that the clamping device 3 can be moved to a practically infinite number of different positions relative to the clamping device 4; all that is necessary is to loosen the screw 14 and to shift the arm 8 longitudinally against that resistance which is offered by the elastically deformable bearing 11. The screw 14 is thereupon tightened to reliably secure the clamping devices 3 and 4 at a selected distance from each other. This constitutes an important advantage over conventional coupling means which employ a substantially sleeve-like self-locking bearing but do not employ an affixing element (such as the element 12, 14 in the shoulder rest of FIGS. 1 and 2). Thus, if the affixing element 12 were omitted, the arm 8 would be free to move longitudinally of the carrier 2 in response to stresses which exceed a certain value. This would entail a change of the position of the instrument relative to the shoulder of the player which, in turn, would affect the quality of play. Moreover, the affixing element 12, 14 ensures that the clamping devices 3, 4 will be maintained at an optimum distance from each other irrespective of the age of the shoulder rest and irrespective of the condition of the (at least initially) elastically deformable bearing 11. Age and temperature changes can influence the elasticity of the bearing 11, especially after an extended period of use of the improved shoulder rest. On the other hand, the bearing 11 exhibits the important advantage that it permits practically infinite adjustments of the distance of the clamping device 3 from the clamping device 4 and reliably holds the two clamping devices at a selected distance from each other until the screw 14 is tensioned so that retention of the clamping device 3 at a selected distance from the clamping device 4 is then taken over by the affixing element 12, 14 or the affixing element takes over the major part of the task of preventing uncontrolled changes in the distance of the clamping devices 3, 4 from each other. The shoulder rest 1 of FIG. 2 renders it possible to rigidly affix the element 12, 14 to the arm 8 while the shoulder rest is detached from the body 6. This is due to the fact that the shoulder rest 1 of FIG. 2 permits a certain amount of axial movability of the arm 8 relative to the carrier 2 while the screw 14 tightly engages the arm because the bearing 11 is capable of undergoing axial deformation which can suffice to ensure that the clamping devices 3, 4 can be disengaged from or can engage the rim 6*d* of the body 6 without prior loosening of the screw 14.

It will be seen that the improved shoulder rest combines (a) the advantages of conventional shoulder rests which can establish a self-locking connection between the two clamping devices but which are not capable of ensuring adequate engagement with the body of an instrument in response to the application of pronounced stresses in the longitudinal direction of the carrier, and (b) the advantages of conventional shoulder rests which lack a self-locking connection but are provided with means for positively fixing the two clamping devices at a selected distance from each other.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A shoulder rest for connection to a body of a stringed musical instrument, comprising a shoulder-engaging member; an elongated carrier for said member, said carrier having spaced-apart first and second portions; a first clamping device connected with said first portion and engageable with a first part of said body; a second clamping device engageable with a second part of said body; and means for adjustably coupling said second device to said second portion of said carrier, including an elongated arm provided on said second device and extending substantially longitudinally of said carrier, first and second spaced-apart stops provided on said carrier, a substantially sleeve-like bearing between said stops, and an affixing element between said bearing and said first stop, said arm longitudinally movably extending through said stops, said bearing and said affixing element, and said element comprising means for releasably engaging said arm.

2. The shoulder rest of claim 1, wherein said first stop is nearer to and said second stop is more distant from said second device.

3. The shoulder rest of claim 1, wherein said second stop is nearer to and said first stop is more distant from said second device.

4. The shoulder rest of claim 1, wherein said engaging means comprises a threaded fastener.

5. The shoulder rest of claim 1, wherein said bearing consists at least in part of an elastomeric material.

6. The shoulder rest of claim 1, wherein said member is deformable.

7. The shoulder rest of claim 1, wherein at least one of said devices comprises a firs section which is arranged to releasably engage said body and a second section adjustably secured to said first section and disposed at one of said portions of said carrier.

8. The shoulder rest of claim 1, wherein said carrier includes a plate.

9. The shoulder rest of claim 1, wherein said stops are spaced apart a predetermined distance and said bearing and said element have a combined axial length which at least approximates said predetermined distance

10. The shoulder rest of claim 1, wherein at least one of said stops receives said arm with at least some radial play.

* * * * *